United States Patent [19]

Neuser

[11] Patent Number: 4,665,669

[45] Date of Patent: May 19, 1987

[54] RECTANGULAR CEILING PANELS FOR FALSE CEILINGS

[75] Inventor: Udo Neuser, Heimenkirch, Fed. Rep. of Germany

[73] Assignee: Gema Bauelemente AG, Switzerland

[21] Appl. No.: 912,792

[22] Filed: Sep. 26, 1986

[30] Foreign Application Priority Data

Oct. 4, 1985 [DE] Fed. Rep. of Germany ..... 3535540

[51] Int. Cl.[4] ..... E06B 3/50; E04F 19/08

[52] U.S. Cl. ..... 52/204; 52/475; 52/484

[58] Field of Search ..... 52/484, 475, 204, 303, 52/145

[56] References Cited

U.S. PATENT DOCUMENTS

| | | | |
|---|---|---|---|
| 2,698,071 | 12/1954 | Lee | 52/484 |
| 2,913,571 | 11/1959 | Smith | 52/145 X |
| 3,013,644 | 12/1961 | Smith et al. | 52/475 X |
| 3,359,695 | 12/1967 | Gazerro | 52/204 X |
| 3,362,122 | 1/1968 | Schmitt | 52/484 |
| 3,473,280 | 10/1969 | Stahlhut | 52/475 |

*Primary Examiner*—Alfred C. Perham

*Attorney, Agent, or Firm*—Ostrolenk, Faber, Gerb & Soffen

[57] ABSTRACT

A ceiling panel 6 has on each of two longitudinal sides at least one protrusion (24, 26) having a transverse edge (36, 38). The transverse edges are aligned with each other and constitute swing bearing surfaces on which the ceiling element may be swung down from its normal horizontal position in the false ceiling and suspended on two spaced parallel support rails in a generally vertical open position. The ceiling element is constructed of a single metal plate with stamped bent-off edge sections that form the protrusions that permit displacement of downward swung ceiling panels in the longitudinal direction of the support rails, and strengthen the ceiling panel so that it may have large longitudinal and transverse dimensions.

14 Claims, 8 Drawing Figures

RECTANGULAR CEILING PANELS FOR FALSE CEILINGS

BACKGROUND OF THE INVENTION

1. Field of the Invention

The present invention relates generally to false ceilings and more particularly relates to means for conveniently permitting access to the region above the false ceiling.

2. The Prior Art

Federal Republic of Germany OS No. 31 20 410 discloses a false ceiling constructed of rectangular elements or panels constituting ceiling tiles having swing bearing protrusions at one end thereof for suspension of the panel from a support rail that is fastened to the true ceiling. A clip lock actuated by a screw element having a closure lever, which rests on the support rail, fastens the other end of the panel. The closure lever is concealed at the bottom of the ceiling tile so that such lever is accessible only by utilizing special tools. The panel is of a plate-shaped flat form so that it can be used only when of small size since in the case of larger sizes sagging will result because of a lack of inherent stiffness. Manufacture is relatively expensive because several parts must be manufactured separately and connected to each other.

Swiss patent No. 639,720 discloses a rectangular ceiling panel having an edge with protrusions projecting in the same direction from said edge near opposite ends thereof. The panel also includes a downward extending arm having at its free end, a barb which points back towards the edge. The two protrusions are hung on a support rail of the false ceiling so that the ceiling element can be swung downward around this support rail to obtain an opening in the false ceiling. This opening provides workmen access to electric wires, water pipes, ventilation ducts, air conditioning systems, smoke alarms, etc., which may be mounted between the false ceiling and the building or true ceiling from which the false ceiling is suspended.

Federal Republic of Germany OS No. 35 17 932 discloses a complicated and expensive construction for a false ceiling which requires stampings, clamping elements and springs for attachment of the ceiling elements.

When the false ceilings of the prior art are opened for installation or maintenance work, the opening formed by the removal of a ceiling element is often inconveniently small. Furthermore, especially when large openings are required, the ceiling elements removed are frequently not suspended from a support rail but are taken completely out of the false ceiling and placed on the floor because merely swinging the element down is too complicated or the false ceiling opening which is uncovered thereby is too small. When the panels are placed on the floor there is the danger that the panels will become scratched or otherwise damaged.

SUMMARY OF THE INVENTION

The instant invention is directed to constructing a ceiling element in such a manner that it is stable when produced in large dimensions, so that the uncovering of large openings in the false ceiling is possible without many ceiling elements having to be removed from the false ceiling and placed on the floor, while at the same time the ceiling elements can be manufactured more easily and at lower cost than ceiling elements of the prior art.

This problem is solved in accordance with the instant invention by providing a single metal plate that constitutes a bottom or main wall, side walls which are formed on the bottom by upward bending and extend transversely and longitudinally with respect to the support rails. Protrusions for hanging the panels are bent outward from the wall edges that are remote from the bottom.

In accordance with the instant invention, a false ceiling is characterized by the fact that it has at least two rectangular ceiling panels of this type which are arranged one behind the other between two parallel support rails and are supported by their protrusions which rest on the support rails positioned therebelow. In this construction the ceiling elements can be lifted, positioned obliquely and then lowered between the support rails until the protrusions which constitute swing bearings are suspended on the two parallel support rails. The downward swung, suspended ceiling elements are adapted to be shifted along the support rails, on their swing bearing protrusions to form an unobstructed opening of useful size. At least one of the swing bearing protrusions is provided with a hook formation that extends into a depression in the support rails and cooperates therewith to prevent the panel from sliding transverse to the support rails and dropping therefrom.

OBJECTS OF THE INVENTION

Accordingly, the primary object of this invention is to provide false ceiling panels that are economical to manufacture and are convenient to manipulate for uncovering relatively large unobstructed openings for access to the space above the false ceiling.

Another object is to provide false ceiling panels of this type that are of one piece construction.

Still another object is to provide false ceiling panels of this type that are constructed of thin gauge sheet material.

A further object is to provide false ceiling panels of this type that are rigid even when of large size.

A still further object is to provide false ceiling panels of this type that are provided with bearings that permit the panels to be swung to vertical positions and then slide along the support rails to positions that result in forming an unobstructed opening that is larger than a single panel.

BRIEF DESCRIPTION OF THE DRAWINGS

The foregoing objects as well as other objects of this invention shall become readily apparent after reading the following description of the accompanying drawings in which.

DETAILED DESCRIPTION OF THE PREFERRED EMBODIMENTS

Figure 1:
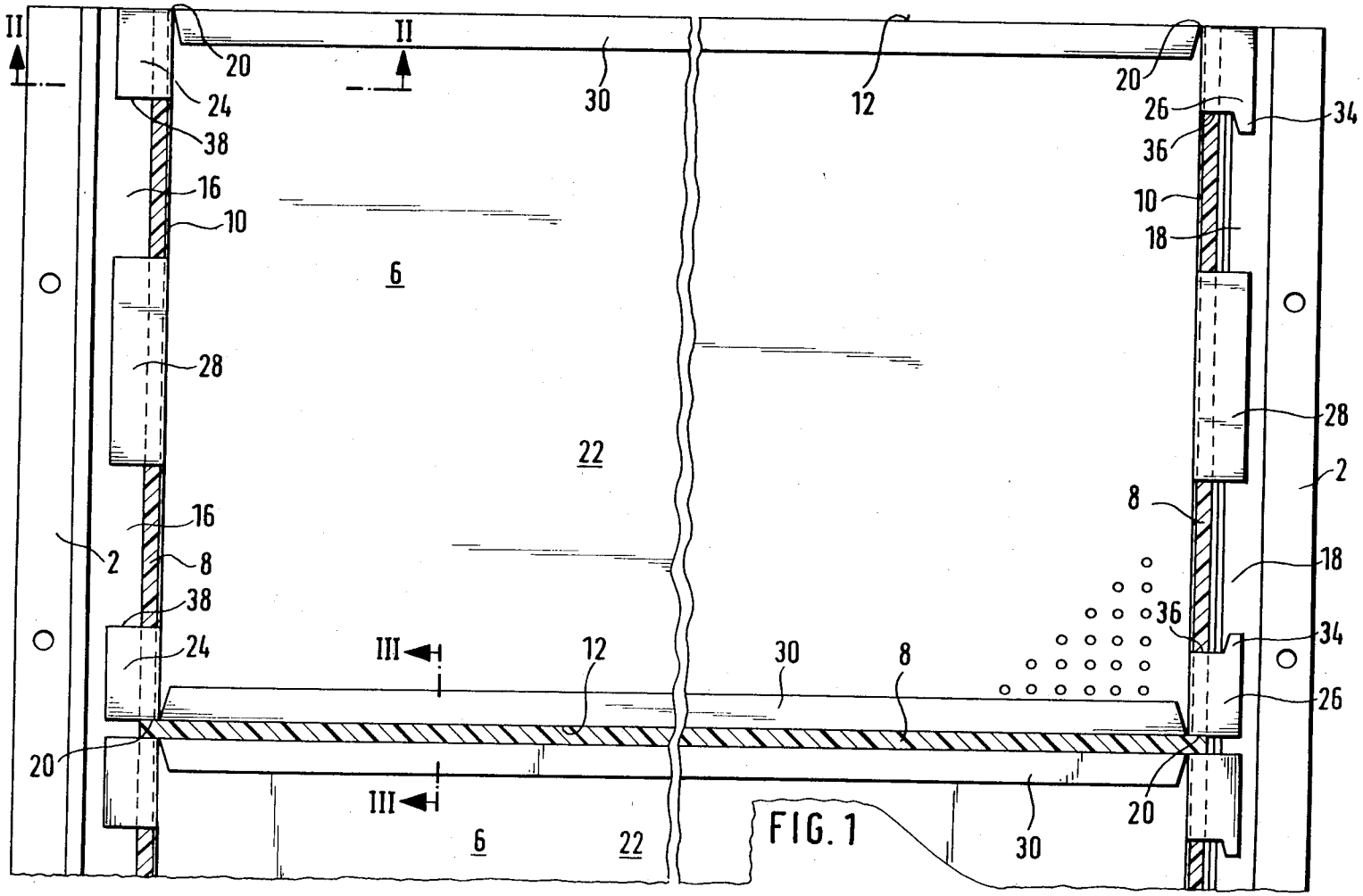
FIG. 1 a top plan view of a false ceiling having plate-shaped ceiling elements or panels constructed in accordance with the teachings of the invention.

Now referring to drawing FIGS. 1–4 that illustrate a false ceiling including support rails 2 arranged in spaced parallel relation and fastened to building ceiling 4. Rails 2 support plate-shaped rectangular ceiling elements or panels 6 that are normally arranged one behind the other and between support rails 2. Elastic sealing strips 8 are cemented to the longitudinally (with respect to rails 2) extending side walls 10 and transversely extending side walls 12 of the ceiling elements 6, so to be between support rails 2 and ceiling elements 6, as well as between successive ceiling elements 6. Strips 8 function to seal joints and compensate for measurement tolerances.

Each ceiling panel 6 is a stamped, bent and cut single piece unit constructed of sheet metal. More particularly, panel 6 is a very shallow pan-like element that includes a rectangular bottom or main wall 22. With panel 6 in its normal position mounted so as to extend between two rails 2 with main wall 22 horizontal and slightly below rails 2, short longitudinal walls 10 extend along the opposite shorter edges of main wall 22 projecting upward therefrom and short transverse walls 12 extend along the opposite longer edges of main wall 22 projecting upward therefrom.

Prior to upwardly bending of walls 10 and 12, cutouts 16 are stamped outboard of one wall 10, cutouts 18 are stamped outboard of the other wall 10 and cutouts 20 are stamped where the ends of walls 10 and 12 meet. This provides outward protrusions 24, 26, 28 along the upper edges of walls 10 and inwardly protruding sections 30 along the upper edges of walls 12. Protrusions 24, 26, 28 lie in a common plane parallel to main wall 22. All of the protrusions 24, 26 and 28 rest on support rails 2 when ceiling element 6 is in its normal position shown in FIGS. 1, 2 and 3. When ceiling element 6 is installed, its main wall 22 is horizontal and forms part of the ceiling plane of the entire false ceiling with bottom wall 22 being the lowermost visible portion of the false ceiling.

Protrusions 24 are located at opposite ends of one side wall 10 and protrusions 26 are located at opposite ends of the other side wall 10. One protrusion 28 is disposed between protrusions 24 and the other protrusion 28 is disposed between protrusions 26. Protrusions 24 and 28 are rectangular as seen in the top view of FIG. 1. Also as seen in the top view of FIG. 1, each protrusion 26 has a hook-shaped nose-like part 34 protruding in the direction towards the protrusion 28 which is located between protrusions 26. Parts 34 extend in the plane of protrusions 26, 28 and 24. Edge 36 of each protrusion 26 extends in the transverse direction of the ceiling element 6 (direction perpendicular to length of rail 2), from longitudinal side wall 10 to part 34. Edge 38 of rectangular protrusion 24 which faces adjacent protrusion 28 extends at right angles to longitudinally extending side wall 10 and parallel to the bottom wall 22.

Protrusions 24 and 26, located at the same end of ceiling element 6 (top of FIG. 1) form a pair of swing bearing protrusions whose inner edges 36 and 38 serve as swing bearing surfaces that are in a line parallel to transverse walls 12. In the same way, protrusions 24 and 26 located at the other end of element 22 (bottom of FIG. 1) form a pair of swing bearing protrusions whose inner edges 36 and 38 are aligned with each other and form swing bearing surfaces. The nose-like or hook-like parts 34 of the swing bearing protrusions 26 are without effect as long as the ceiling element 6 is in its normal position with all protrusions 24, 26, 28 on support rails 2.

Figure 4:
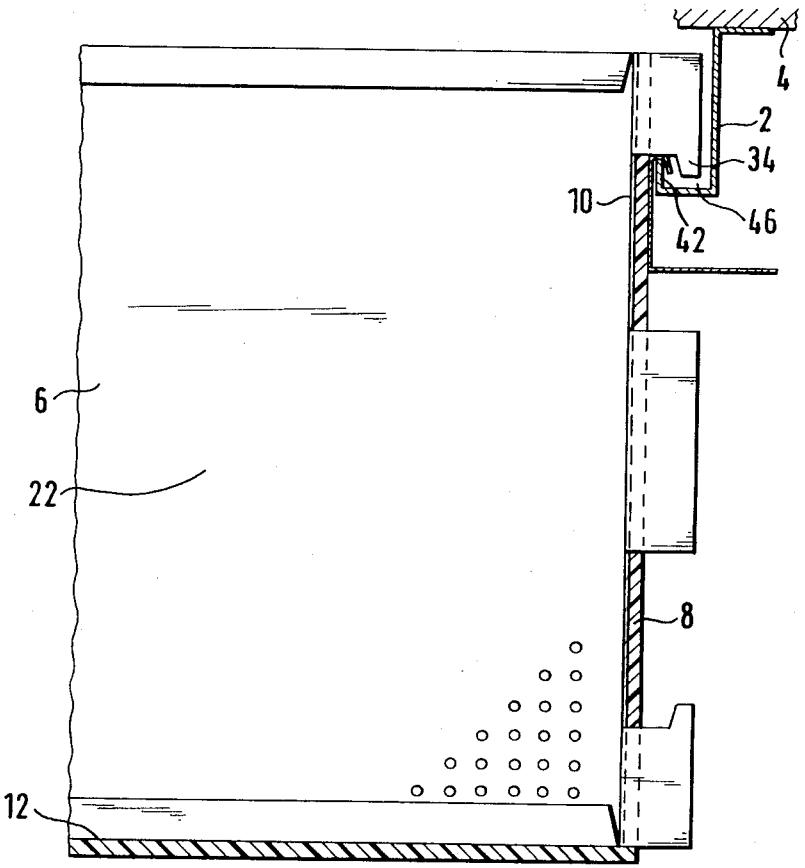
FIG. 4 is a fragmentary side elevation showing the right-hand part of a ceiling element shown in FIG. 1, swung downward to its open position.
Figure 2:
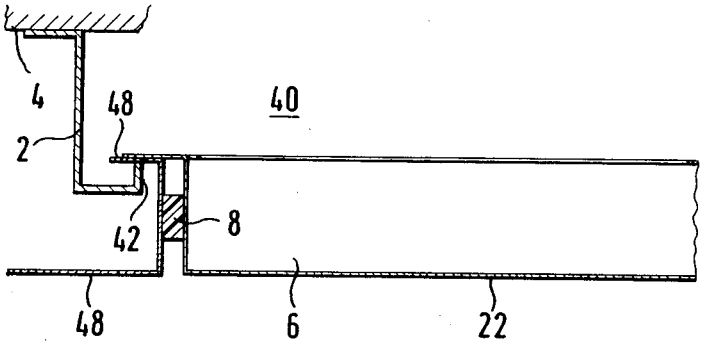
FIG. 2 is a cross section through line II—II of FIG. 1 looking in the direction of arrows II—II.
Figure 3:
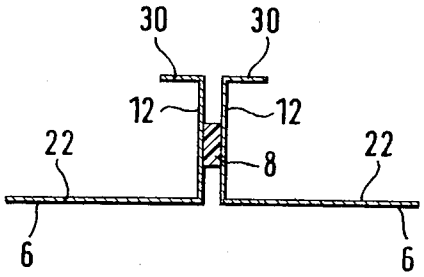
FIG. 3 is a cross section through line III—III of FIG. 1 looking in the direction of arrows III—III.
Figure 5:
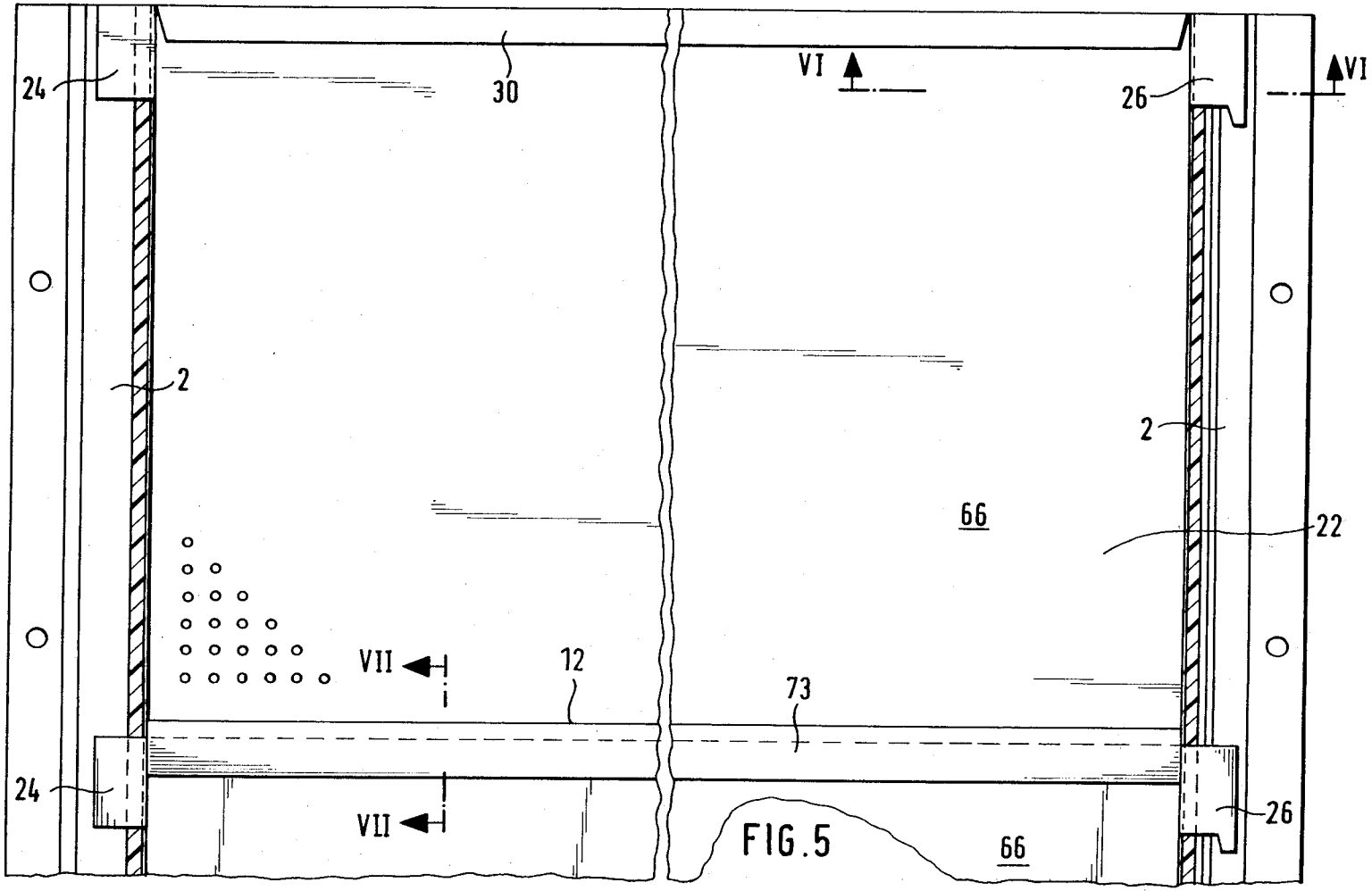
FIG. 5 is a top plan view of another embodiment of a false ceiling having ceiling elements constructed in accordance with teachings of the instant invention.
Figure 6:
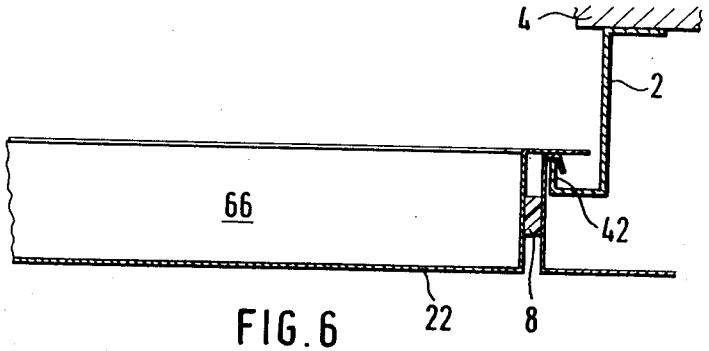
FIG. 6 is a cross section through line VI—VI of FIG. 5 looking in the direction of arrows VI—VI.
Figure 7:
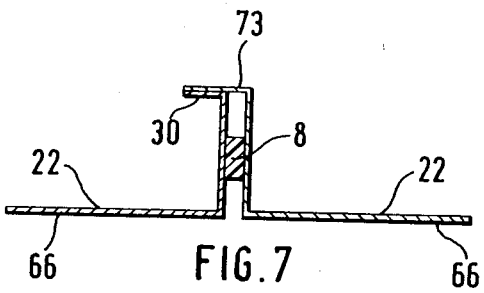
FIG. 7 is a cross section through line VII—VII of FIG. 5 looking in the direction of arrows VII—VII.

In order to provide access to space 40, between true ceiling 4 the plane of the false ceiling, for installation or maintenance purposes, one or more of the ceiling elements 56 can be lifted and then positioned obliquely at an angle that permits the ceiling element 6 to be lowered between support rails 2 without 24, 26, 28 interfering with support rails 2. Ceiling element 6 is then lowered so that arms 42 of support rails 2 are located between the upper (with respect of FIG. 1) cutouts 16 and 18 of the tilted ceiling element 6, and thereafter swing bearing surfaces 36 and 38 are lowered into engagement with arms 42 of support rails 2. Now element 6 is suspended from support rails 2 by the upper protrusions 24 and 26 so that gravity positions main wall 22 in a generally vertical plane (FIG. 4). The downward-hanging ceiling element 6 can be displaced lengthwise of support rail 2 by sliding therealong. In this way, by swinging down and suspending several ceiling elements 6 and shifting them longitudinally along support rails 2, an access opening which is much larger than main wall 22 can be formed between support rails 2. The length of the opening corresponds approximately twice the longitudinal panel measurement, the width corresponds to the entire distance between support rails 2, and this opening is not obstructed by a ceiling element 6 or other potential cross member.

It is clear from viewing FIG. 4 that by swinging ceiling element 6 down, the hook-shaped or nose-shaped part 34 of protrusion 26 engages behind arm 42 of the support rail 2. In this way, part 34 together with the closely spaced longitudinally extending side wall 10 prevent sliding of ceiling element 6 in both transverse directions so that even a downward-swung suspended ceiling element 6 cannot drop to the floor. In the embodiment shown in FIGS. 1 to 4, only in the case of arm 42 for the support rail 2 shown on the right is there unobstructed access to space 46 which permits the latter to receive hook-shaped or nose-shaped part 34 behind the support arm 42 is not possible. For this reason, protrusions 24 do not have hook-shaped or nose-shaped parts 34.

Since the ceiling element 6 has a pair of swing bearing protrusions 24, 26 on each of its two ends (at the top and bottom of FIG. 1), element 6 can be swung downward out of the plane of the false ceiling either toward the front or toward the rear and be suspended on a pair of swing bearing surfaces 36, 38.

It should now be apparent to those skilled in the art that protrusions 24, in identical or similar manner to the protrusions 26, may also have hook-shaped or nose-shaped parts 34 which, upon swinging ceiling element 6 downward, engage behind the supporting upward directed arm 42 of the support rail 2 shown to the left in the drawings, provided sufficient clearance for such engagement is present behind arm 42.

Longitudinally extending side walls 10, transversely extending end walls 12, protrusions 24, 26 and 28 and inwardly turned edge sections 30 of the transversely extending side walls 12 impart stability and rigidity to ceiling element 6, as a result of which ceiling element 6 can be manufactured even with large dimensions in the longitudinal and transverse directions. For this reason, cutouts 16 and 18 should not be too long in the longitudinal direction so that the bottom 22 of the ceiling element will not sag. In the case of very long ceiling elements 6 it is advisable to have more than two cutouts 16 or 18 on the longitudinal sides, with a corresponding plurality of center protrusions 28 instead of one very long center protrusion 28. This will prevent sagging of the bottom or main wall 22, while at the same time weight is conserved.

Now referring more particularly to FIGS. 5 through 8 wherein the same reference numerals used in FIGS. 1 through 4 are applied to like elements in all the drawing figures.

Figure 8:
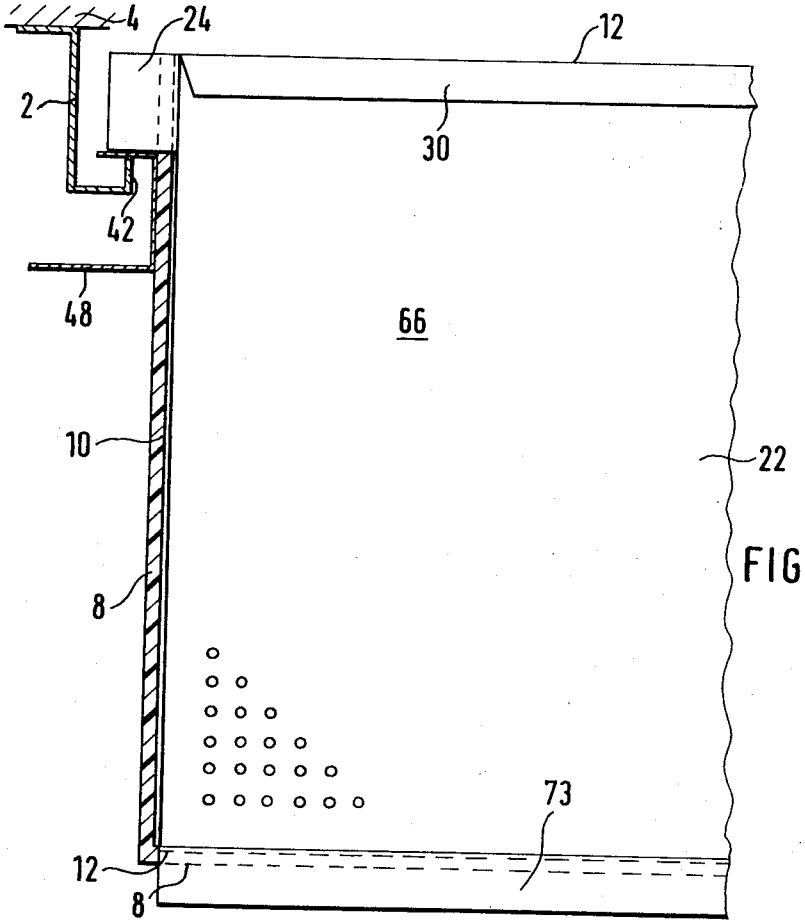
FIG. 8 is a fragmentary side elevation showing the left-hand part of a ceiling element shown in FIG. 5, swung downward to its open position.

The embodiment illustrated in FIGS. 5 through 8 differs from the embodiment of FIGS. 1 through 4 in that the pair of protrusions 24 and 26 on which the downward-swung ceiling element or panel 66 can be suspended, as shown in FIG. 8, is provided only at one end. In its normal position swung up into the plane of the ceiling, panel 66 is positioned by protrusions 24 and 26 at one end engaging support rails 2 and at the other end of element 66 an edge section 73 which is bent outward 90° from the transversely extending side wall 12 to be parallel to main wall 22 and rests on the longitudinally adjacent ceiling element 66, shown at the bottom of FIG. 5. In this way section 73 of the ceiling element 66 shown at the top of FIG. 5 lies over section 30 of the ceiling element 66 shown at the bottom of FIG. 5 and the pair of protrusions 24, 26 arranged at the top thereof lie on the two support rails 2 which extend parallel to each other (see FIGS. 5 and 7).

Although the present invention has been described in connection with a plurality of preferred embodiments thereof, many other variations and modifications will now become apparent to those skilled in the art. It is preferred, therefore, that the present invention be limited not by the specific disclosure herein but only by the appended claims.

What is claimed is:

1. A ceiling panel for constructing a false ceiling that is supported by parallel rails, said panel being an integral unit formed from a single metal plate and including:

a rectangular main wall having along its periphery opposed short longitudinal walls and opposed short transverse walls extending between said longitudinal walls at opposite ends thereof, said walls being arranged in a very shallow pan-like configuration, and a plurality of protrusions extending from said walls at the edges thereof remove from said main wall and extending generally parallel to a plane in which said main wall is disposed;

a first and a second of said protrusions extending outward in opposite directions from the respective longitudinal walls and being disposed off center with respect to the length of said longitudinal walls;

said first and second protrusions constituting swing bearings that include swing bearing surfaces engageable with false ceiling support rails disposed therebelow to permit said panel to swing between a normal position wherein said main wall is in a horizontal false ceiling plane and an open position wherein said panel extends downward from said plane with said main wall being generally vertical;

said swing bearing surfaces being disposed in a common line positioned parallel to said transverse walls.

2. A ceiling panel as set forth in claim 1 in which at least an additional one of said protrusions extends outward from each of said longitudinal walls to rest upon false ceiling support rails disposed therebelow; said additional protrusions being disposed in a common plane containing said first and second protrusions.

3. A ceiling panel as set forth in claim 1 in which a third and a fourth of said protrusions extends outward in opposite directions from the respective longitudinal walls and are disposed off center with respect to the length of said longitudinal walls;

said first and third protrusions extending from one of said longitudinal walls and being disposed on opposite sides of its midpoint; said second and fourth protrusions extending from the other of said longitudinal walls and being disposed on opposite sides of its midpoint;

each of said third and fourth protrusions having a swing bearing surface;

said swing bearing surfaces of said third and fourth protrusions being disposed in a common line positioned parallel to said transverse walls and facing the swing bearing surfaces of the respective first and second protrusions.

4. A ceiling panel as set forth in claim 3 in which:

said one longitudinal wall being provided with at least an additional one of said protrusions disposed between said first and third protrusions to rest upon false ceiling support rails disposed therebelow;

said other longitudinal wall being provided with at least an additional one of said protrusions disposed between said second and fourth protrusions to rest upon false ceiling support rails disposed therebelow.

5. A ceiling panel as set forth in claim 1 in which:

a further one of said protrusions extends from one of said transverse walls and outboard of said main wall to be supported by an adjacent false ceiling panel disposed below said further protrusion;

said first and second protrusions being closer to the other of said transverse wall than to said one transverse wall.

6. A ceiling panel as set forth in claim 4 in which:

a further one of said protrusions extends from one of said transverse walls and outboard of said main wall to be supported by an adjacent false ceiling panel disposed below said further protrusion;

said first and second protrusions being closer to the other of said transverse wall than to said one transverse wall.

7. A ceiling, panel as set forth in claim 1 in which at least one of said first and second protrusions includes a hook-like formation that extends downward into a support rail recess when said panel is in said open position to prevent said panel from moving transverse to such support rail.

8. A ceiling panel as set forth in claim 4 in which at least one of said first and second protrusions includes a hook-like formation that extends downward into a support rail recess when said panel is in said open position to prevent said panel from moving transverse to such support rail.

9. A ceiling panel as set forth in claim 6 in which at least one of said first and second protrusions includes a hook-like formation that extends downward into a support rail recess when said panel is in said open position to prevent said panel from moving transverse to such support rail.

10. A false ceiling and hanging means for suspending said false ceiling from a true ceiling positioned thereabove, said hanging means including first and second spaced parallel horizontal support rails, said false ceiling including first and second panels normally positioned with a lateral wall of said first panel adjacent a lateral wall said second panel, each of said panels including:

a rectangular main wall having along its periphery opposed short longitudinal walls and opposed short transverse walls extending between said longitudinal walls at opposite ends thereof, said walls being arranged in a very shallow pan-like configuration, and a plurality of protrusions extending from said walls at the edges thereof remove from said main wall and extending generally parallel to a plane in which said main wall is disposed;

a first and a second of said protrusions extending outward in opposite directions from the respective longitudinal walls and being disposed off center with respect to the length of said longitudinal walls;

said first and second protrusions constituting swing bearings that include swing bearing surfaces engageable with said first and second rails, respectively, to permit said panel to swing between a normal position wherein said main wall is in a horizontal false ceiling plane and an open position wherein said panel extends downward from said plane with said main wall being generally vertical;

said swing bearing surfaces being disposed in a common line positioned parallel to said transverse walls;

said panels when in said open positions being slideable on said swing bearing surfaces along said rails lengthwise thereof for locations where an unobstructed opening approximately the combined area of said first and second panels is formed in said ceiling.

11. A false ceiling and hanging means for suspending said false ceiling as set forth in claim 10 in which for each of said panels at least an additional one of said protrusions extends outward from each of said longitudinal walls to rest upon said rails disposed therebelow; said additional protrusions being disposed in a common plane containing said first and second protrusions.

12. A false ceiling and hanging means for suspending said false ceiling as set forth in claim 10 in which for each of said panels a third and fourth of said protrusions extends outward in opposite directions from the respective longitudinal walls and are disposed off center with respect to the length of said longitudinal walls;

said first and third protrusions extending from one of said longitudinal walls and being disposed on opposite sides of its midpoint; said second and fourth protrusions extending from the other of said longitudinal walls and being disposed on opposite sides of its midpoint;

each of said third and fourth protrusions having a swing bearing surface;

said swing bearing surfaces of said third and fourth protrusions being disposed in a common line positioned parallel to said transverse walls and facing the swing bearing surfaces of the respective first and second protrusions.

13. A false ceiling and hanging means for suspending said false ceiling as set forth in claim 12 in which for each of said panels:

said one longitudinal wall being provided with at least an additional one of said protrusions disposed between said first and third protrusions to rest upon said rails disposed therebelow;

said other longitudinal wall being provided with at least an additional one of said protrusions disposed between said second and fourth protrusions to rest upon said rails disposed therebelow.

14. A false ceiling and means for hanging same as set forth in claim 10 in which for each of said panels:

a further one of said protrusions extends from one of said transverse walls and outboard of said main wall to be supported by an adjacent false ceiling panel disposed below said further protrusion;

said first and second protrusions being closer to the other of said transverse wall than to said one transverse wall.

* * * * *